US005730006A

United States Patent [19]

Conley

[11] Patent Number: 5,730,006

[45] Date of Patent: Mar. 24, 1998

[54] GARMENT DE-WRINKLER

[76] Inventor: Christopher T. Conley, P.O. Box 11484, Southport, N.C. 28461

[21] Appl. No.: 777,516

[22] Filed: Dec. 30, 1996

Related U.S. Application Data

[63] Continuation-in-part of Ser. No. 354,352, Dec. 12, 1994, abandoned.

[51] Int. Cl.[6] ..... D06B 5/24

[52] U.S. Cl. ..... 68/6; 34/622; 68/5 C; 223/51

[58] Field of Search ..... 8/149.3; 68/5 C, 68/6; 223/51, 70, 73; 34/622, 218

[56] References Cited

U.S. PATENT DOCUMENTS

| | | | |
|---|---|---|---|
| 2,703,973 | 3/1955 | Fawcett | 68/6 |
| 2,915,229 | 12/1959 | Paris | 223/70 |
| 2,925,945 | 2/1960 | Jackson | 223/70 |
| 2,986,312 | 5/1961 | Petzold et al. | 223/70 |
| 3,254,813 | 6/1966 | Paris | 223/70 |
| 3,264,755 | 8/1966 | Moore | 34/622 |
| 3,594,917 | 7/1971 | Montgomery | 34/622 |
| 3,601,292 | 8/1971 | Bliss | 223/51 |
| 3,752,373 | 8/1973 | Smith | 223/51 |
| 3,805,561 | 4/1974 | Bullock | 68/5 C |
| 4,572,364 | 2/1986 | Jordon | 34/622 X |
| 5,094,020 | 3/1992 | Wingfield et al. | 223/51 X |
| 5,305,484 | 4/1994 | Fitzpatrick et al. | 68/6 X |

*Primary Examiner*—Philip R. Coe
*Attorney, Agent, or Firm*—Mills & Assoc.

[57] ABSTRACT

This invention is a garment de-wrinkler that includes a garment bag with a threaded opening in the bottom thereof. A device for controlling the interior environment of the garment bag is inserted into the opening in the bag. The environmental controller is in the form of an exterior canister that is open at both end with a fan mounted adjacent the exterior end. A second canister is mounted interiorly of the exterior canister and includes heating electrodes to create steam from the water or other liquid contained in the interior canister. Air heating elements are provided in the area between the interior wall of the exterior canister and the exterior wall of the interior canister so that when ambient air is blown over the coil the air will be heated prior to entering the garment bag. Finally an automatic timer is provided that automatically steams for a predetermined amount of time with the heated, dry air being introduced for an approximately twice as long so that the garment or garments within the garment bag can be both de-wrinkled and dried.

16 Claims, 5 Drawing Sheets

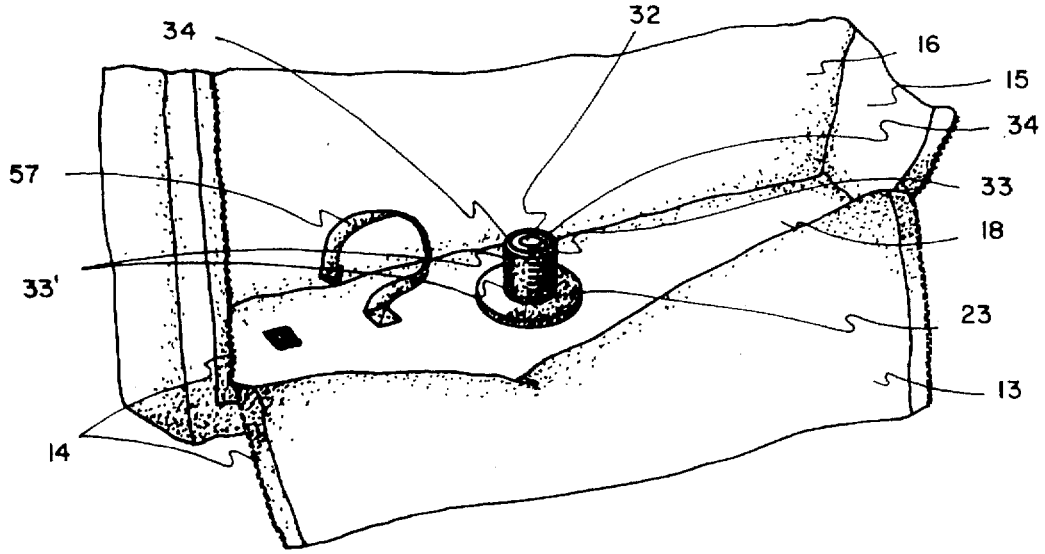
FIG. 3
FIG. 4
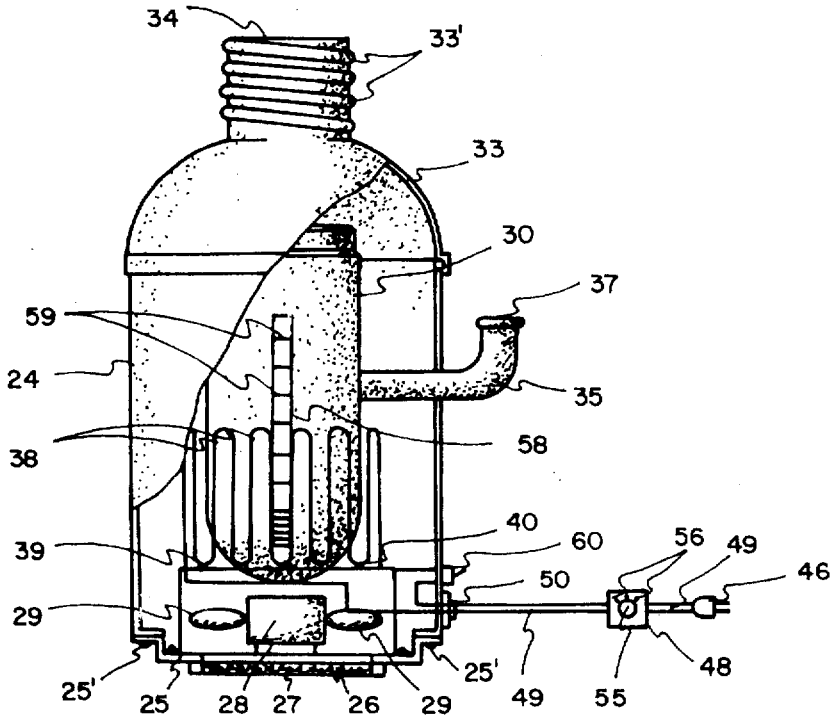

GARMENT DE-WRINKLER

This application is a continuation-in-part, of application Ser. No. 08/354,352, filed Dec. 12, 1994, now abandoned.

FIELD OF INVENTION

This invention relates to garment treating means and more particularly to means for removing wrinkles from garments, particularly when traveling.

BACKGROUND OF INVENTION

When people travel, it is has always been a problem in maintaining a wardrobe that is wrinkle free. With the present return in popularity of 100 percent cotton garments, the need to de-wrinkle clothing is even more of a problem.

Various means for steaming, drying and even de-wrinkling of garments have been devised. These have even included travel-type bags as well as rather complicated steam chests or closets. Many of these units are relatively complicated, not readily portable and are not highly efficient to use.

Concise Explanation of Prior Art

U. S. Pat. No. 3,264,755 to Moore discloses a clothes drying bag with a rather unwieldy air heating blower connected to the bottom thereof through a flexible hose.

U. S. Pat. No. 3,594,917 to Montgomery discloses a garment bag with steamer wherein the steamer is permanently mounted in the bottom thereof. Also the garment bag is of the type that will hang in a closet but not the type that would be suitable for carrying clothes during travel.

U. S. Pat. No. 3,601,292 to Bliss also discloses a garment treating apparatus with a fan and steam assembly permanently provided in the lower portion thereof. The handle on the top of this apparatus is for suspending the same from a hook or the like during use. Again this is not a bag in which clothes could be carried during travel.

U.S. Pat. No. 3,752,373 to Smith discloses a portable wardrobe refresher that is rather large and bulky, would be heavy to transport even without garments being disposed therein, and is complicated in structure.

U.S. Pat. No. 4,572,364 to Jordan discloses a clothes drying garment bag that can be used when traveling but is not for de-wrinkling clothes since the neck of a portable blower-type hair dryer is disposed within a foldable enclosure gusset.

Finally, U. S. Pat. Nos. 2,703,973 to Fawcett, 3,805,561 to Bullock and 5,094,020 to Wingfield et al are all considered of general interest in that they disclose cabinets in which clothing can be hung during treatment but certainly none of these units are portable and all are relatively complex in structure.

BRIEF DESCRIPTION OF INVENTION

After much research and study into the above mentioned problems, the present invention has been developed to provide a garment bag suitable for carrying clothes during travel as well as being usable for use when at home. A relatively small, readily portable interior environmental control unit is provided that can be readily attached and separated from the lower portion of the bag. A sight gauge is used to determine the amount of water to be added for the length of time that the de-wrinkling, steaming process will operate. The environmental unit can move cold air or heated air from the outside of the bag into the interior thereof either before, during, or after the steaming process. The air flow means can also be used by itself. It is also easy to fill and dump prior to and after use and can be readily transported either in the bottom of the garment bag or in any other convenient means of transport and storage.

In view of the above, it is an object of the present invention to provide a means for de-wrinkling garments both at home and during travel.

Another object of the present invention is to provide, in a travel-type garment bag, a means for controlling the interior environment to de-wrinkle and dry the clothing contained therein.

Another object of the present invention is to provide a small, simple, readily portable means connected to a portable garment bag for removing wrinkles in the clothing contained therein.

Another object of the present invention is to provide an interior environment modifying means for removing wrinkles from clothes in a hanging clothing bag.

Other objects and advantages of the present invention will become apparent and obvious from a study of the following description and the accompanying drawings which are merely illustrative of such invention.

BRIEF DESCRIPTION OF DRAWINGS

FIG. 3 is an enlarged perspective view of the interior of the bottom of the bag with the environmental control unit projecting thereinto;

FIG. 4 is a somewhat schematic view of the unit for controlling the interior environment of the garment bag;

DETAILED DESCRIPTION OF INVENTION

The garment de-wrinkler of the present invention, indicated generally at 10, includes a garment bag portion indicated generally at 11 and a canister-like environmental control portion indicated generally at 12.

Figure 1:
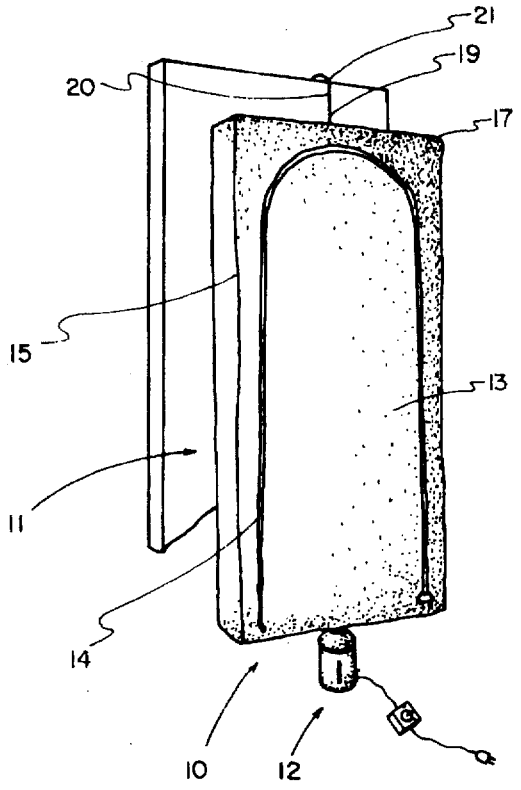
FIG. 1 is a perspective view of the garment de-wrinkler of the present invention.
Figure 2:
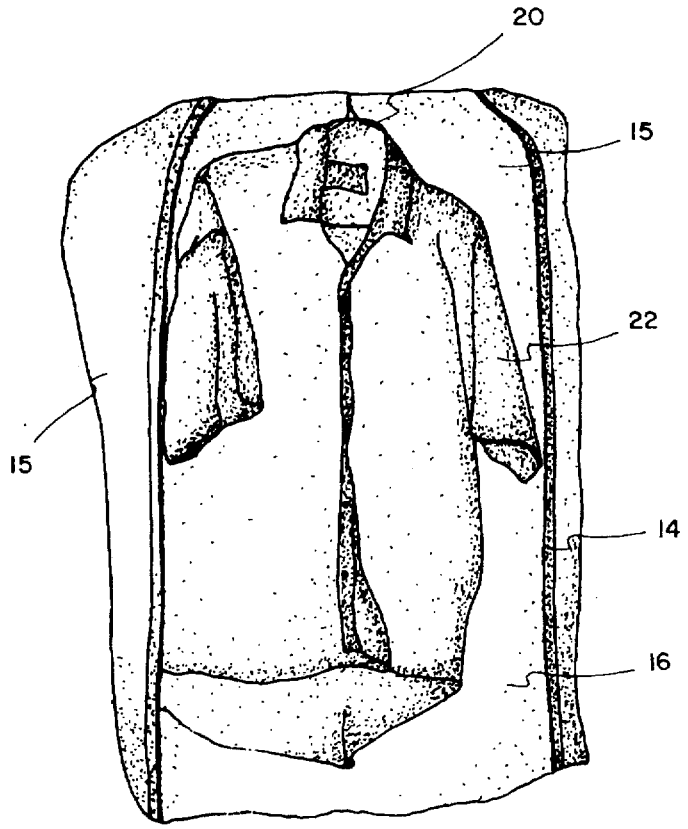
FIG. 2 shows the bag portion of the present invention open with clothes to be de-wrinkled disposed therein.
Figure 5:
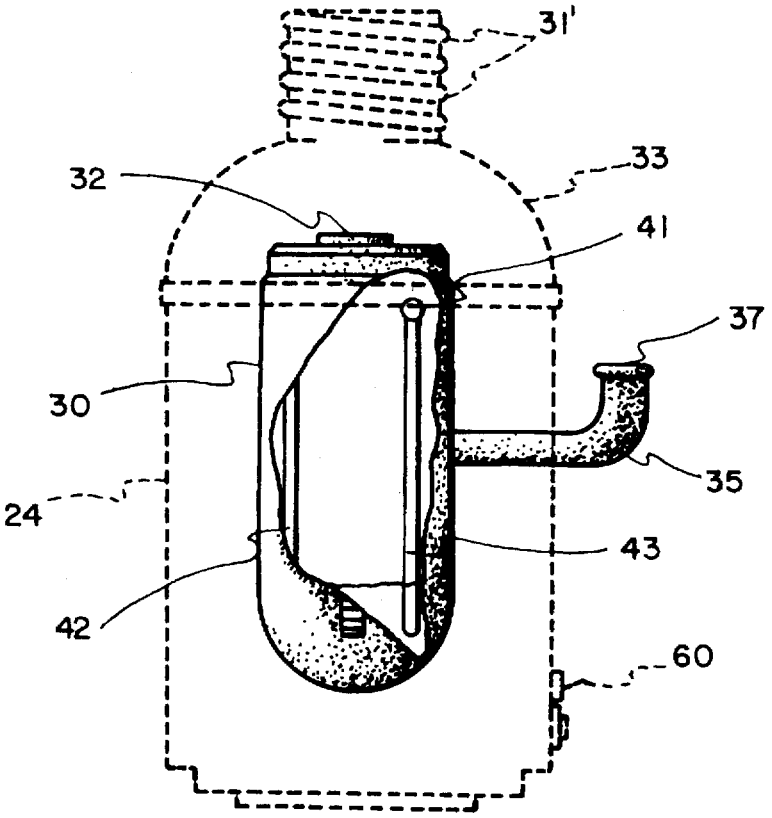
FIG. 5 is a somewhat schematic view of the interior canister.

The garment bag 11 includes a front panel 13 that can be opened and closed by means such as zipper 14. The garment bag 11 also has side walls 15, a back 16, a top 17 and a bottom 18 as can clearly be seen in FIGS. 1 and 2.

An opening 19 is provided in the top 17 of garment bag 11 so that one or more garment hangers 20 can pass therethru to support the garment bag on any convenient structure 21. A portion of the garment hanger 20 that is interior of the garment bag 11 can support the garment of garments 22 during travel and during de-wrinkling.

A threaded opening 23 is provided in the bottom 18 of garment bag 11 and is adapted to hold the environment control unit 12 in place during the de-wrinkling process. This is, of course, a quick connect and disconnect coupling between the environmental control unit and the bottom 18 of the garment bag 11.

The canister-like means 12 for controlling the interior environment of the garment bag 11 includes a cylindrical shaped exterior canister 24 with a removable bottom 25 having an opening 26 therein for the ingress of ambient air. Securing means such as screws 25' hold bottom 25 in place.

A screen 27 made from wire mesh or other suitable material covers the opening 26 in the bottom 25 of the canister 24.

A fan motor 28 and its associated blades 29 is operatively mounted on bottom 25 of exterior canister 24 above opening 26 as can clearly be seen in FIG. 4. The operative mounting of fan motors and their associated blades within housing is well known to those skilled in the art and further detailed discussion of this portion of the present invention is not deemed necessary.

The upper portion or top 33 is removably snapped onto the cylindrical shaped exterior canister 24. The upper portion 33 is open at the top as indicated at 34 and is threaded as indicated at 33' so that said exterior canister can be twistingly inserted into threaded opening 23 in the bottom 18 of the garment bag 11 and remain there during the de-wrinkling process as will hereinafter be described in greater detail.

A water tight interior canister 30 is centrally mounted within the cylindrical-shaped exterior canister 24 and has an opening 32 in the top thereof.

A filler tube 35 is covered with a snap-on top 37. This filler tube or pipe passes through the cylindrical side wall of exterior canister 24 and the side wall of interior canister 30 to communicate with the interior thereof.

Air heating element 38 is disposed about and in spaced relation to the lower portion of the interior canister 30 with electrical terminals 39 and 40 being provided on opposite ends of such elements. Since the mounting of air heating element is well known to those skilled in the art, further detailed discussion of the same is not deemed necessary.

An electrode support member 41 is provided on the inside of interior canister 30. A pair of water heating electrodes 42 and 43 project downwardly from support member 41 to points adjacent the bottom of the interior canister. Electrical terminals are provided for electrodes 42 and 43.

An electrical plug 46 is provided and can be inserted into any convenient suitable source of electricity (not shown). Electrical cord 47 extends from plug 46 to electrical timer control 48. Electrical cord 49 extends from timer 48 through the exterior wall of exterior canister 24. An insulator 50 is provided at this juncture.

Electrical cord 49 is operatively connected to fan motor 28, air heating element 38 and water heating electrodes 42 and 43.

If desired, a separate off/on switch 60 can be provided for manual operation of the present invention.

The exterior canister 24 is preferably made from a clear material or can have a window in the side thereof. Sight gauge 58 is provided on the exterior of interior canister 30 which is also preferably formed from a clear material. Time indicia 59 is provided on the sight gauge 58 and can be used as minute indicia to tell the user how much water to place in the interior canister for the number of minutes it is desired for the same to steam.

To use the garment de-wrinkler of the present invention, the hook portion of the hanger 20 is placed over a convenient structure which can be either a hanging rod, the molding of a door, or the like. If the garment 22 is not already in the garment bag 11 it can be placed therein on hanger 20. The environmental control unit 12 of the present invention is then inserted into the garment bag 11 by threading the upper portion 33' of the exterior canister 24 into the threaded opening 23 in the bottom of the garment bag 11.

Plug 46 is then inserted into any convenient electrical power source (not shown).

The timer 48 is wired so that the timer knob 55 can be set on the desired number of minutes indicated by indicia 56. From experience it has been found that a complete cycle of between 3 and 6 minutes will ordinarily de-wrinkle the clothes within the garment bag but in severely wrinkled garments, more time may be needed.

The number of minutes for steaming is decided upon and the snap-on cap 37 is removed from filler tube 35 and the amount of water poured therethru into the interior canister 30 to the level equal to the number of minutes indicated by time indicia 59 of sight gauge 58. Next, the timer knob 55 is turned to the time indicia 56 equal to approximately twice the number of minutes indicated on the interior canister water level indicia.

The timer 48 will cause the steaming electrodes 42 and 43 to be energized as well as the air heating element 38. The fan motor 28 will also be energized to cause air to flow through the bottom opening 26, around the heating element 38, and out the top 34 of the upper portion 33 of canister 24. The water level in the interior canister 30 will rapidly drop until there is no water left between water electrodes 42 and 43 which will stop the steaming process. Since the timer 48 has been set at twice the time shown on the sight gauge 58, the fan 28 and the air heating element 38 will continue to operate for an additional period of time before automatically cutting off.

The garment or garments contained within the garment bag 11 will be dewrinkled by the steam generated by the interior canister 30 and then will be dried by the continued heated air following cessation of the steaming portion of the cycle.

When the de-wrinkling process is completed, the exterior canister is simply unscrewed from the threaded opening 23 in the bottom 18 of the garment bag 11 and removed therefrom. The plug 46 is removed from the power source and the environmental control unit 11 can then be placed in the bottom of the garment bag or other convenient location until it is used again. If desired, a strap 57 with Velcro or other securing means can be provided in the bottom 18 of the garment bag 11 to hold the environmental control unit 12 in place when not in use.

Figure 6:
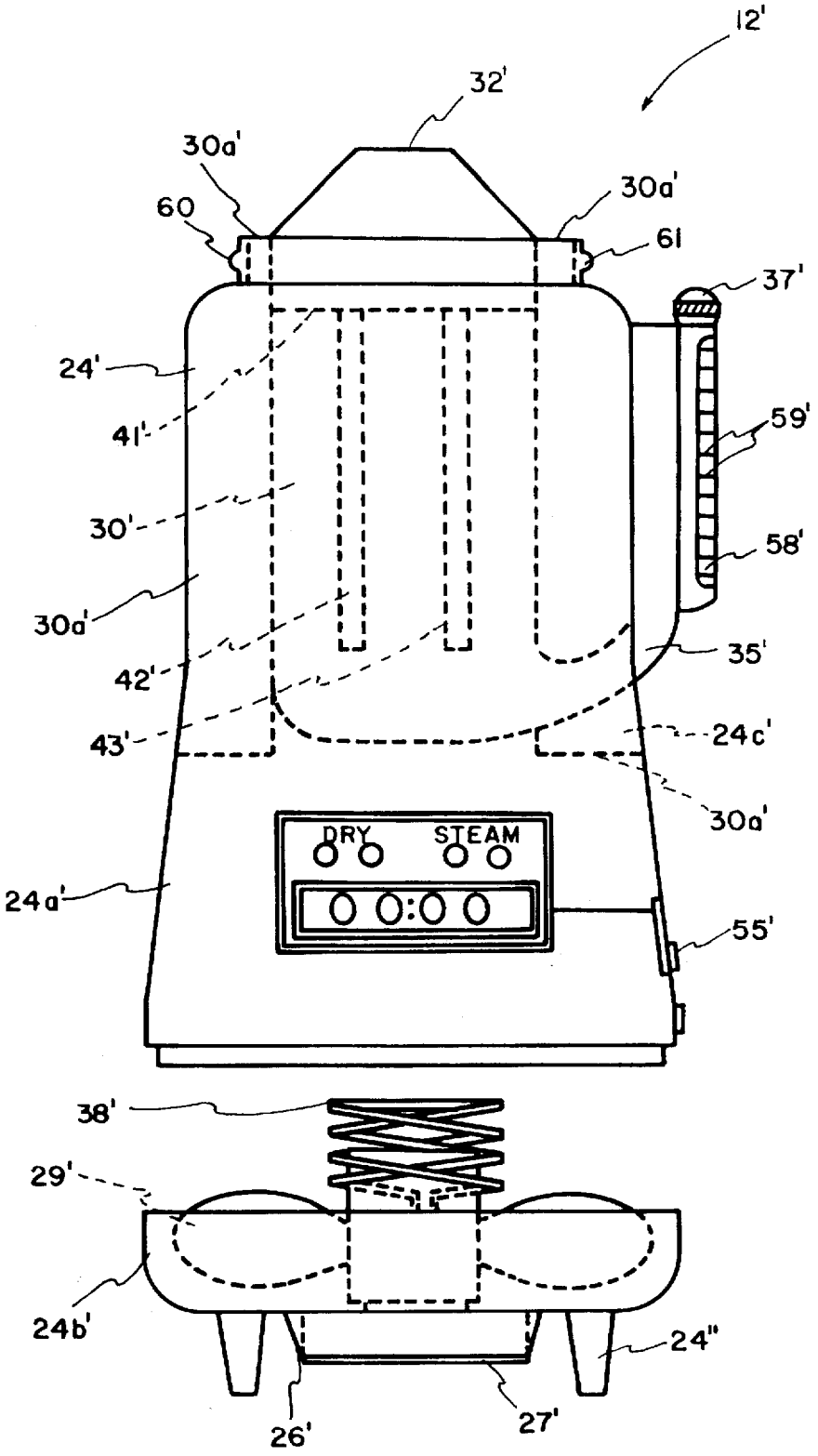
FIG. 6 is an exploded, schematic view of an alternative embodiment of the environmental control unit of the present invention.

Referring now to FIG. 6, there is shown therein a modified version of the environmental control unit, indicated generally at 12'.

In this embodiment, a water-tight interior canister 30' is also centrally mounted within a generally cylindrical shaped exterior canister 24' including downwardly and outwardly tapered side wall portions **24*a'***.

Interior canister 30' includes a filler tuber 35' being integrally formed and in fluid communication with interior canister 30'. It can be seen that filler tube 35' extends through the sidewall of exterior canister 24' to an outside surface thereof and is provided with a filler top 37'.

Filler tube 35' includes a sight gauge 58' which is fabricated from a clear material. Sight gauge 58' includes time indicia 59' which are utilized as a visual reference for how much water to place in the interior canister 30' for the number of minutes it is desired to produce steam.

Exterior canister 24' includes a detachable base portion 24b' wherein a fan motor 28' and its associated blades 29' are operatively mounted in coaxial alignment above opening 26' as shown in FIG. 6.

Base portion 24b' is provided with a plurality of downwardly extending legs 24b" which enable the entire control unit 12' to be placed on a flat surface for the convenience of the user.

The dust screen 27' is fabricated from a suitable material and covers the opening 26' in the bottom surface of the base portion 24b'.

Air heating element 38' is radially disposed about fan motor 28' in spaced-apart relation thereto as shown in FIG. 6. Thus, air heating element 38' is positioned intermediate interior canister 30' and blades 29' in its functional position within exterior canister 24'.

An electrode support member 41' is provided on the inside of interior canister 30' in a manner similar to that described hereinabove. Similarly, a pair of water heating electrodes 42' and 43' project downwardly from support member 41' to points adjacent the bottom of the interior canister 30'. Electrical terminals are also provided for electrodes 42' and 43'.

In this embodiment, an upper end of interior canister 30' includes inwardly and upwardly tapered sidewalls converging to form a steam opening 32' having a safety screen 32a' installed therein.

Figure 7:
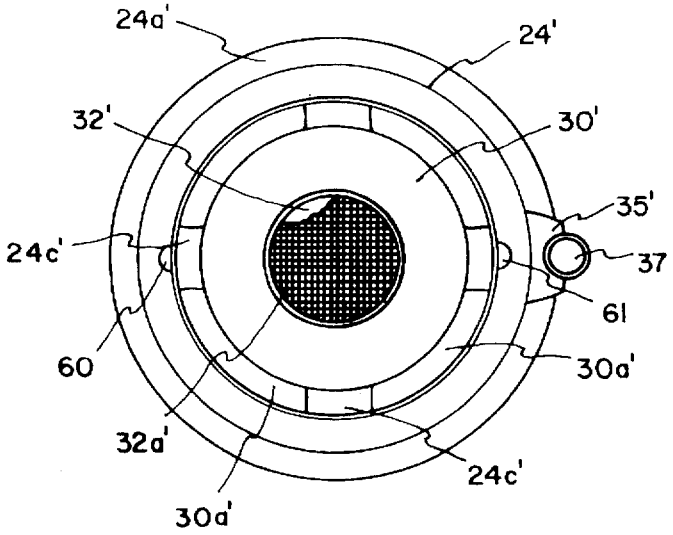
FIG. 7 is a top plan view of the alternative embodiment of FIG. 6 showing the relation of the components therein.

As more clearly shown in FIG. 7, interior canister 30' is arranged in coaxial, spaced-apart relation to exterior canister 24' being supported in this relation by a plurality of interconnecting webs 24c' extending therebetween.

Webs 24c' may be integrally formed with exterior canister 24' at predetermined intervals along the inside surface thereof or, in the alternative, may be fixedly attached thereto by suitable fastening means.

A plurality of air passages 30a' are formed between each adjacent pair of webs 24c' being defined by an outer surface of interior canister 30' and an inner surface of exterior canister 24' as shown in FIG. 7.

Air passages permit the egress of the axial air flow through exterior canister 24' into the garment bag 11 during operation of fan motor 28'.

A quick connect and disconnect coupling 33" is provided at the top edge of exterior canister 24' to enable the same to be twistingly engaged into a mating opening in the bottom of the garment bag 11.

In normal operation the fan blades 29' draw ambient air through opening 26' which passes over heating element 38' and flows in an axial direction around interior canister 30' and through air passages 30a' and into the garment bag.

This embodiment includes a timer 48' having a digital display of the steam and air cycles. The timer 48' may be set to correspond to the desired length of time selected for a particular cycle.

In this embodiment, coupling 33" is provided with electrical terminals 60 and 61 fixedly attached thereto and electrically connected to timer 48'.

Figure 8:
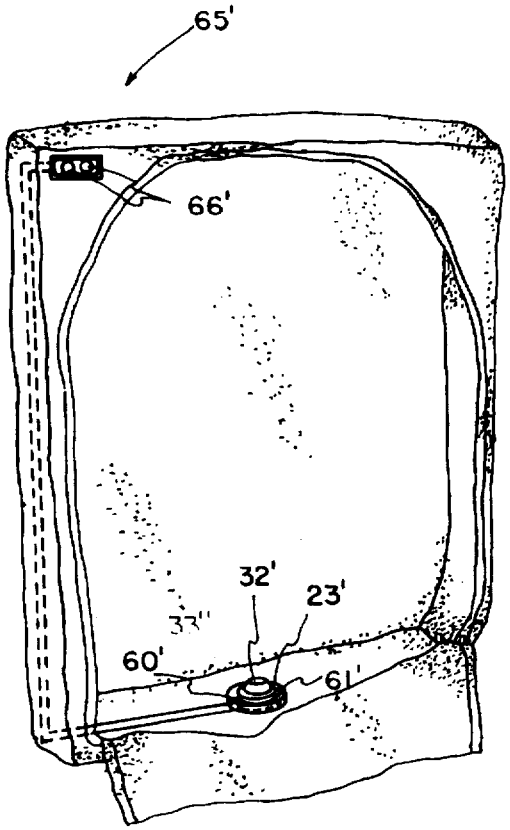
FIG. 8 is a front perspective view of the garment bag showing the light display panel mounted thereon.

The mating portion 23' of coupling 33" installed within the bottom of garment bag 11' is provided with electrical terminals 60' and 61' as shown in FIG. 8.

Terminals 60' and 61' are electrically connected to a light display panel, indicated generally at 65', which is mounted in an upper portion of bag 11' so as to be clearly visible to a user of the invention.

Display panel 65' includes a plurality of cycle indicator lights 66' installed therein. Lights 66' are operatively connected to timer 48' so as to be illuminated during a particular steam or heated air cycle to inform the user of the cycle in progress.

Thus, the user is protected from accidentally opening garment bag 11' during the steam and heated air cycles ensuring proper operation and avoiding possible injury.

Since such light display panels are well known to those skilled in the art, further detailed discussion of the same is not deemed necessary.

The modified version of the present invention also includes a power control switch 55' which is mounted directly in the sidewall of exterior canister 24' for the convenience of the user as shown in FIG. 6.

From the above it can be seen that the present invention has the advantage of providing a relatively simple, and yet highly efficient means for de-wrinkling garments. The present invention can be used when traveling as well as at home. It uses a minimum amount of energy and can be easily stored when not in use.

The terms "upper", "bottom", "top", "back" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A garment de-wrinkling means including a garment bag wherein garments can be removably placed, said garment bag including an opening in the bottom thereof, the improvement comprising: means for controlling the interior environment of said garment bag including an elongated exterior housing having openings in opposite ends thereof; an elongated interior housing that is open at one end and is designed to receive a de-wrinkling liquid therein; means for heating the liquid within the interior housing to create steam which escapes through the opening in the end thereof; means for heating air that passes through the exterior housing that ingresses through one end and egresses from the other end; and means for removably mounting the egress end of said exterior housing in the opening in the bottom of the garment bag whereby steam can be introduced into said garment bag from said interior housing and drying heated air can be introduced thereinto through said exterior housing.

2. The means of claim 1 wherein a motor driven fan is mounted within said exterior housing to force air to flow through said housing.

3. The means of claim 1 wherein the means for creating steam within the interior housing is a pair of electrodes operatively connected to an electrical source.

4. The means of claim 1 wherein the means for heating the air passing through the exterior housing is at least one heating element operatively connected to an electrical source.

5. The means of claim 1 wherein a setable timer is operatively connected to steam creating electrodes, an air heating element and a fan motor for forcing air to flow through said housing.

6. A portable garment de-wrinkling apparatus comprising:

a garment bag including an opening in a bottom thereof, said garment bag being provided with hanger means whereon one or more garments may be hung;

steam generating means including an elongated interior canister having a discharge opening at one end thereof, said canister being adapted to receive water therein;

means for forcing ambient air into said garment bag including an exterior housing having ingress and egress openings in opposite ends thereof, said housing being radially disposed about said interior canister in generally coaxial, spaced-apart relation thereto, said housing including a rotary fan motor mounted adjacent said ingress opening;

means for heating said air as it is drawn through said exterior housing including an air heating element disposed adjacent said ingress opening and intermediate said fan motor and said interior canister; and quick connect and disconnect means for removably mounting said exterior housing in said opening in said garment bag whereby steam can be introduced into said garment bag from said interior canister and heated air can be introduced thereinto through said exterior housing.

7. The apparatus of claim 6 wherein said steam generating means includes a pair of electrodes positioned within said interior canister, said electrodes being operatively connected to an electrical source.

8. The apparatus of claim 6 wherein said air heating element is radially disposed about said fan motor in coaxial, spaced-apart relation thereto, said element being operatively connected to an electrical source.

9. The apparatus of claim 6 wherein a timer is electrically connected to said steam generating means, said air heating element, and said fan motor, said timer including a digital display for controlling the duration of a steam generating cycle and an air flow cycle.

10. The apparatus of claim 6 wherein said interior canister includes a generally cylindrical filler tube being integrally formed therewith adjacent a bottom surface thereof, said filler tube extending outwardly through said exterior housing and upwardly in generally parallel relation to said interior canister.

11. The apparatus of claim 10 wherein said filler tube includes a sight gauge fabricated from a transparent material, said sight gauge being disposed external to said exterior housing whereby a user of said apparatus may readily determine the water level within said interior canister.

12. The apparatus of claim 11 wherein said sight gauge is provided with a plurality of indicia thereon at predetermined intervals, said intervals corresponding to the amount of water that will be converted to steam during a timed cycle of said steam generating means.

13. The apparatus of claim 6 wherein said interior canister is supported in said coaxial, spaced-apart relation to said exterior housing by a plurality of radially disposed webs projecting inwardly from an inner surface of said exterior housing and contacting an outer surface of said interior canister.

14. The apparatus of claim 13 wherein said inner surface of said exterior housing, said outer surface of said interior canister, and said webs define a plurality of air passages therebetween whereby an axial flow of ambient air is directed through said passages into said garment bag.

15. The apparatus of claim 6 wherein said quick connect and disconnect means includes mating electrical terminals which are positioned in operative contact when said quick connect and disconnect means is engaged.

16. The apparatus of claim 15 wherein said terminals are electrically connected to said timer and to a light display panel disposed on said garment bag, said display panel including a plurality of cycle indicator lights whereby a user may ascertain whether a particular cycle is in progress.

* * * * *